United States Patent [19]

Singer

[11] Patent Number: 4,585,270

[45] **Date of Patent: * Apr. 29, 1986**

[54] SUPPORT STRUCTURE FOR A PIECE OF FURNITURE

[76] Inventor: Mark Singer, 15 Madison St., Cambridge, Mass. 02138

[ * ] Notice: The portion of the term of this patent subsequent to Dec. 20, 2000 has been disclaimed.

[21] Appl. No.: 562,409

[22] Filed: Dec. 16, 1983

Related U.S. Application Data

[63] Continuation-in-part of Ser. No. 332,371, Dec. 21, 1981, Pat. No. 4,421,356, which is a continuation-in-part of Ser. No. 236,756, Feb. 23, 1981, abandoned.

[51] Int. Cl.[4] ..... A47C 4/02

[52] U.S. Cl. ..... 297/16; 248/165; 297/441

[58] Field of Search ..... 297/16, 18, 25, 24, 297/45, 440, 441, 445, 449, 457; 248/163.1, 164, 165, 432

[56] References Cited

U.S. PATENT DOCUMENTS

| | | | |
|---|---|---|---|
| 244,216 | 7/1881 | Fenby . | |
| 1,142,006 | 6/1915 | Barber . | |
| 1,969,313 | 8/1934 | Meeker . | |
| 2,689,602 | 9/1954 | Morgan . | |
| 3,123,395 | 3/1964 | Glass | 297/16 |
| 3,455,604 | 7/1969 | Turcksin | 297/441 |
| 3,901,551 | 8/1975 | Wiesner . | |
| 3,972,559 | 8/1976 | Anacker . | |
| 4,014,591 | 3/1977 | Gittings . | |
| 4,118,064 | 10/1978 | Robeson . | |
| 4,148,520 | 4/1979 | Miller . | |
| 4,239,280 | 12/1980 | Ackerman | 297/18 |
| 4,251,106 | 2/1981 | Gilbert | 297/441 |
| 4,290,643 | 9/1981 | Logan, 3rd | 297/16 |
| 4,421,356 | 12/1983 | Singer | 297/16 |

FOREIGN PATENT DOCUMENTS

| | | | |
|---|---|---|---|
| 539567 | 7/1955 | Belgium | 297/18 |
| 389653 | 3/1922 | Fed. Rep. of Germany | 297/449 |
| 565716 | 2/1924 | France | 297/18 |
| 11379 | of 1913 | United Kingdom . | |
| 183986 | 8/1922 | United Kingdom | 297/18 |

*Primary Examiner*—William E. Lyddane
*Assistant Examiner*—Mark W. Binder

[57] ABSTRACT

Substantially rigid support structure for a piece of furniture, having a pair of transversely spaced struts in substantially fixed relationship to each other, the axes of the struts being inclined with respect to the horizontal, an integral rigid member having two upper ends spaced from each other and two lower ends spaced from each other and being oppositely inclined with respect to the horizontal and positioned intermediate the struts, and a plurality of tension members interconnecting the struts and the rigid member to form a substantially rigid structure.

13 Claims, 8 Drawing Figures

SUPPORT STRUCTURE FOR A PIECE OF FURNITURE

This application is a continuation-in-part of Singer Ser. No. 332,371 now U.S. Pat. No. 4,421,356, filed on Dec. 21, 1981, which is a continuation-in-part of Singer Ser. No. 236,756 now abandoned, filed Feb. 23, 1981.

FIELD OF THE INVENTION

This invention relates to support structures for chairs and the like.

BACKGROUND OF THE INVENTION

Lightweight support structures have, in the past, been used to provide a frame for "sling"-type chairs, i.e., chairs in which the seating surface consists of a piece of flexible fabric supported either at its four corners or along two nonadjacent sides. The fabric is usually sized such that, when attached to the frame, it is not taut, but drapes somewhat and thus provides both posterior and back support.

Often the support structure has been made up of a number of support members which are pivotably attached to one another, such that the chair may be collapsed for transportation, etc. Fenby, U.S. Pat. No. 244,216 and Morgan, U.S. Pat. No. 2,689,602 disclose such support structures.

More recently, support structures constructed solely of pure tension members and pure compression members have been devised. The pure compression members are commonly struts (e.g., poles), the ends of which are interconnected by the pure tension members, usually cables or ropes. Support structures of this type, examples of which are to be found in Miller, U.S. Pat. No. 4,148,520 and Wiesner, U.S. Pat. No. 3,901,551, have been termed "tensegrity" (or "tensional-integrity") types of structures.

The term "tensegrity" was apparently coined by Buckminster Fuller, to describe structures which, as described in Fuller, R. B., *Synergetics*, Collier MacMillian (1975), have the ability "to yield increasingly without ultimately breaking or coming asunder". Such structures inherently lack rigidity. A more comprehensive treatment of tensegrity is to be found in the above referenced work.

Rocking chairs have been provided by support structures having two rigid (i.e., compression) members that each have upper end portions that are spaced from each other and lower end portions that are spaced from each other. The rigid members are oppositely inclined with respect to the horizontal, intersecting each other in side view, and one of the rigid members is positioned intermediate the other. The rigid members are connected to each other near their bottoms by one pair of flexible tension members and above where they intersect by another pair of flexible tension members, and the rigid members can pivot about their points of contact with the ground providing the rocking movement. Examples of such support structures are disclosed in Meeker, U.S. Pat. No. 1,969,313; Robeson, U.S. Pat. No. 4,118,064; and Gilbert, U.S. Pat. No. 4,251,106. Meeker and Robeson teach that the structures can be modified to prevent rocking by adding pin connections between the rigid members where they intersect, and Gilbert discloses preventing backward pivoting beyond a certain point by interference of the rigid members and preventing forward pivoting beyond a certain point by a pair of cords between the rigid members.

SUMMARY OF THE INVENTION

In general the invention features a rigid chair support structure including a pair of transversely spaced struts maintained in substantially fixed relationship to each other, the axes of the struts being inclined with respect to the horizontal and defining an imaginary surface therebetween, an integral rigid member having two upper end portions spaced from each other and two lower end portions spaced from each other and being inclined oppositely to said struts with respect to the horizontal and positioned intermediate the struts to intersect the surface defined thereby, and a plurality of flexible tension members interconnecting the struts and the integral rigid member to form a substantially rigid structure. Specifically, there are at least four flexible tension members. The first two tension members—a first tension member connecting the integral rigid member at its upper end portions wth the struts at a position above said intersection and a second tension member connecting the integral rigid member at its lower end portions to the struts near their bottoms—essentially provide a rocking chair type support in which the integral rigid member and the struts are free to pivot about their points of contact with the ground. The third tension member connects the integral rigid member to the struts in position to prevent forward pivoting, and the fourth tension member connects the integral rigid member to the struts in position to prevent backward pivoting, resulting in a completely rigid, immobilized structure.

In preferred embodiments the first tension member (the upper one) is substantially horizontal and provides support for a seat cushion; the struts are fixedly connected to each other by a rigid member between them; the integral rigid member comprises upper and lower horizontal rigid members connected to each other by an inclined rigid member; the struts are curved above where the first tension member is connected to them, to provide support for a chair back at a steeper angle from the horizontal than the angle below the seat cushion; and the second, third and fourth tension members are provided in pairs connected at corresponding positions on opposite sides of the support structure.

In some preferred embodiments the fourth tension member is connected between a location on the struts at or near their lower ends and a location on the integral rigid member (most preferably at or near the upper end portions of the integral rigid member) to prevent backward pivoting; and the third tension member is connected between the lower end portions of the integral rigid member and a location on the struts (most preferably where the first tension member is connected to them) to prevent forward pivoting.

In some other preferred embodiments the fourth tension member is connected between the upper end portions of the integral rigid member and a location on the struts (most preferably where the surface they define intersects the integral rigid member) to prevent backward pivoting; and the third tension member is connected between the lower end portions of the integral rigid member and a location on the struts (most preferably where the surface they define intersects the integral rigid member) to prevent forward pivoting,

DESCRIPTION OF THE PREFERRED EMBODIMENT

I turn now to a description of the preferred embodiment, after first briefly describing the drawings.

DRAWINGS

STRUCTURE

Figure 1:
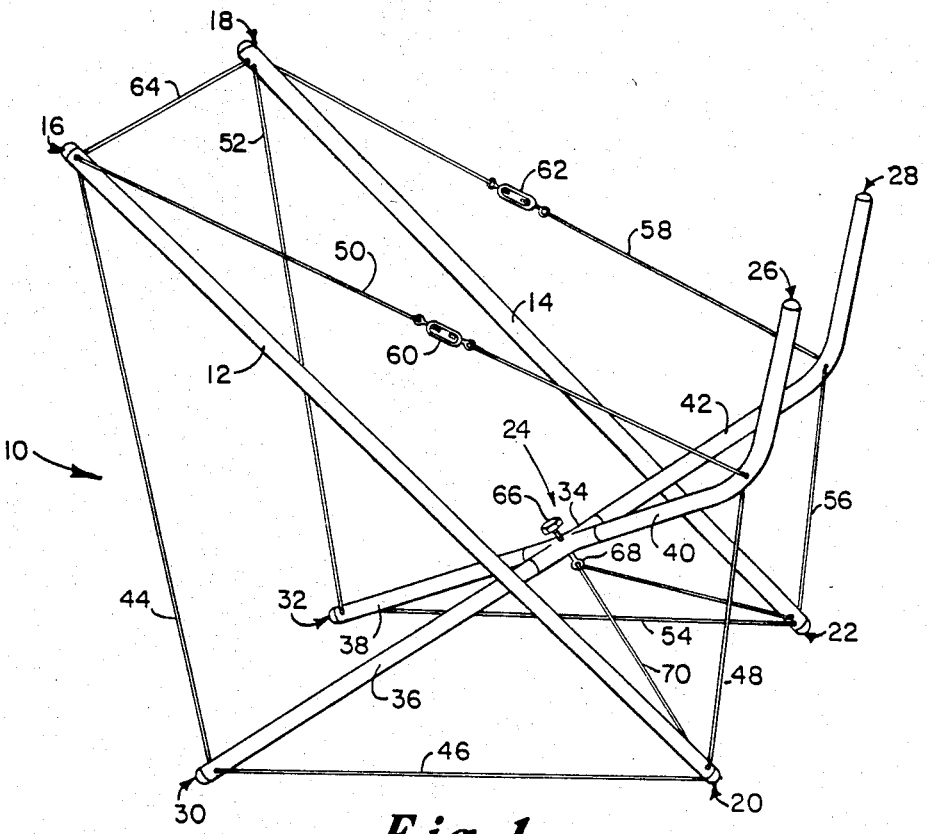
FIG. 1 is an isometric view of a support structure embodying the invention.

Referring now to FIG. 1, support structure 10 includes right and left support struts 12 and 14, respectively, two elongated tubular members which are parallel and transversely spaced from one another and positioned so as to form approximately a 45° angle with the horizontal. Struts 12 and 14 have, respectively, upper ends 16 and 18, which define the top rear of structure 10, and lower ends 20 and 22, which contact the floor, etc. and thereby act as front leg portions. The struts define an imaginary plane surface between them.

Disposed intermediate of struts 10 and 12 and inclined approximately 30° from the horizontal is a rigid X-shaped member 24, having two uppermost ends 26 and 28, which (as described more fully below) serve as the frontmost supports for a fabric sling, and two lowermost ends 30 and 32, which contact the floor, thereby acting as rear leg portions.

While X-member 24 acts in an integral and unitary fashion, in its present embodiment, it is, for purposes of transportability, constructed from a number of submembers: a central hub 34, two straight tubular struts 36 and 38, and two additional struts 40 and 42, of generally doglegged shape. Hub 34 is provided with four threaded holes (not shown) into which screw projecting threaded studs (also not shown) on struts 35, 38, 40 and 42. The depth of threading is such that, when all the submembers are fully engaged, X-member 24 is thereby formed. This particular type of modular construction is not essential to the functioning of support structure 10; X-member 24 could be cast as one integral piece or its submembers could be permanently joined, as by welding. It is critical, however, that, when assembled, X-member 24 function as a singular integral unit.

Four separate cables are attached to each side of structure 10 (i.e., both the right and left sides), so as to generally define a tensional quadrilateral. On the right side of structure 10, cables 44, 46, 48 and 50 define this quadrilateral. The respective corresponding cables on the left side of structure 10 are cables 52, 54, 56 and 58. The above referenced cables act as tension members and attach at or near the eight ends of struts 12 and 14 and X-member 24, the point of attachment to the uppermost portions of X-member 24 being at the dogleg bends rather than at ends 26 and 28.

Turnbuckles 60 and 62 are spliced into cables 50 and 58, respectively, at positions approximately intermediate their end points.

A horizontal cable 64 joins the two uppermost ends 16 and 18 of struts 12 and 14.

Through hub 34 and transverse to X-member 24 is provided a threaded throughgoing hole, through which extends a correspondingly threaded adjustment bolt 66, having an attached eyelet 68. A final cable 70 joins lowermost ends 20 and 22 of struts 12 and 14, passing intermediately through eyelet 68.

Figure 2:
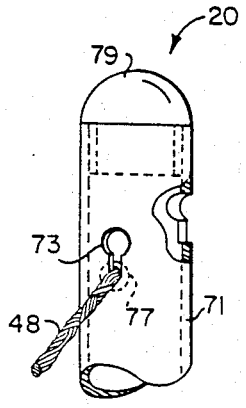
FIG. 2 is a detailed view, partly broken away and in section, of an end of one of the struts of the support structure of FIG. 1, showing the details of cable attachment.

I turn now to FIG. 2, which illustrates the manner in which the above referenced cables are anchored to struts 12 and 14 and X-member 24. Illustratively, end 20 of strut 12 consists of a tubular wall construction 71 (e.g., aluminum tubing), into which has been formed a keyhole-shaped aperture 73. Cable 48 (as well as all other cables) is provided with a "ball shank terminal " 77 which may be inserted into aperture 74 and locked therein by tension. A plastic plug 79 terminates tube 72.

OPERATION

Assembly of structure 10 is straightforward; turnbuckles 60 and 62 are initially adjusted to provide some slack and all cables are secured to their appropriate points of attachment (as shown on FIG. 1), by inserting their ball shank ends into the corresponding keyhole apertures. This completed, turnbuckles 60 and 62 are then tightened to increase the tension in cables 50 and 58. This increases the tension of all the remaining cables and structure 10 becomes increasingly and substantially rigid throughout. Noticeably, the two tensional quadrilaterals tend to force uppermost ends 16 and 18 of struts 12 and 14 apart from one another, thereby increasing the tension in cable 64, a desirable result since insufficient tension in this cable can cause ends 16 and 18 to converge when weight is placed on the structure, causing a general feeling of lack of rigidity. Adjustment bolt 66 may be employed to urge lowermost ends 20 and 22 of struts 12 and 14 closer to one another, with the result that the tension in cable 64 is further increased.

Figure 3:
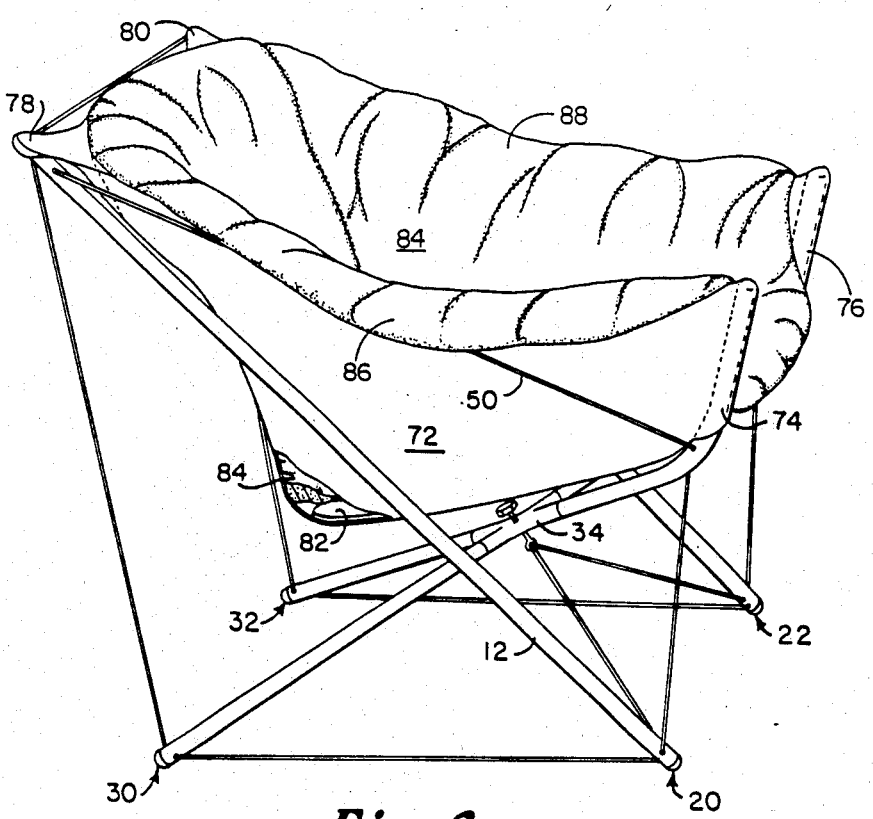
FIG. 3 is an isometric view of the support structure of FIG. 1 supporting a seating system.

Referring now to FIG. 3, in operation, structure 10 is first fitted with a contoured sling 72, having two sewn forward pockets 74 and 76 and two sewn rearward pockets 78 and 80, which, respectively, fit over and are supported by uppermost ends 26, 28, 16 and 18 of struts 12 and 14 and X-member 24. Forward pockets 74 and 76 are of generally cylindrical construction (closed at the top end) and contact a substantial portion of the nearly vertical doglegged portions of X-member 24, thereby providing the sides of sling 72 (which provide armrest support) with some lateral and vertical rigidity.

Sling 72 is preferably contoured in the sense that it is not merely a simple generally rectangular sheet of fabric, but is constructed of a least two pieces of fabric (a bottom piece and a side piece), sewn together to form a shape resembling a so-called "bucket" seat. A stiffener 82, of generally rectangular shape (constructed of, for example, masonite) is placed adjacent the bottom portion of sling 72 to form a more rigid seating surface.

Lastly, a contoured and upholstered cushion 84 is placed over line 72 and stiffener 82, and the construction is complete. Preferably, cushion 84 has extended armrest portions 86 and 88 which drape over the upper side edges of sling 72.

OTHER EMBODIMENTS

Other embodiments are within the following claims. For example, as mentioned above X-member 24 need not be constructed from several constituent submembers but could, instead, be fabricated integrally by any well known method (e.g., welding, casting, etc.); cable 70 (which restrains ends 20 and 22 from moving asunder) and its attendant adjustment bolt 66 may be replaced with a pair of crossing cables, one extending between ends 20 and 32 and the other between ends 30 and 22; cable 70 need not be connected to the mid-point of X-member 24 but may be connected to both arms 40, 42 at a location between their crossing and their ends, or may be connected to both of arms 36, 38 at a location between their crossing and their ends; cable 70 can also be connected to a rigid crossbar connecting either arms 36, 38 or arms 40, 42 at a location between their crossing and their ends; cable 64 and cable 70 can also be interchanged, so that one tension member directly connects ends 20 and 22, while another connects ends 16 and 18 to X-member 24; moreover, sling 72 can be replaced by any other desired support member, rigid or flexible, such as a table top.

Figure 4:
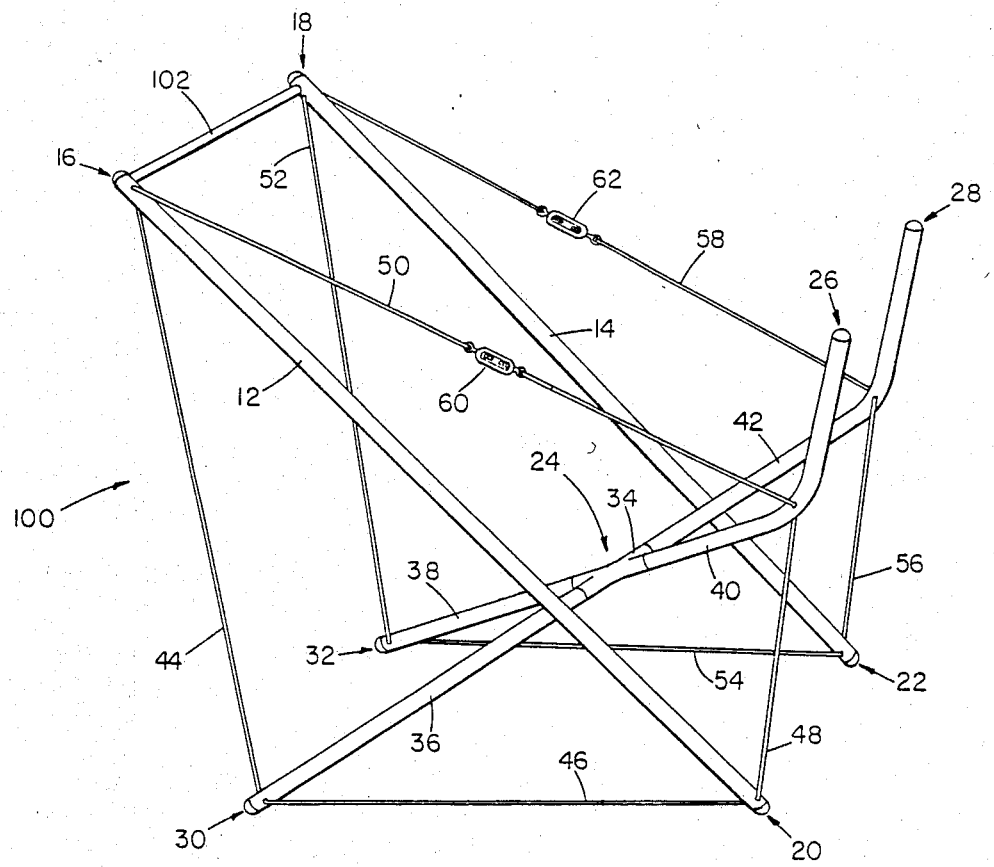
FIG. 4 is an isometric view of another support structure for supporting a seating system similar to that shown in FIG. 3.

Another embodiment, structure 100, is shown in FIG. 4. Structure 100 is the same as structure 10, except that horizontal cable 64, joining the upper ends of columnar struts 12, 14 and cable 70, joining the lower ends, are replaced by a single rigid member 102 connecting the upper ends 16, 18 of struts 12, 14. This holds ends 16, 18 together, as tension cable 64 does in structure 10, and prevents ends 16, 18 from converging when the back of a seat is suspended from it, eliminating any sagging which may occur because of the flexibility of cable 64 and at the same time serving to hold the upper ends of struts 12, 14 in spaced apart position and thus eliminating the need for cable 70. Contoured sling 72, stiffener 82, and cushion 84 can be attached to structure 100 in the manner that they are shown attached to structure 10 in FIG. 3 to provide a chair, but flexible sling 72 may also be suspended from rigid member 102 instead of or in addition to being supported from the upper ends 16, 18 of struts 12 and 14.

Figure 5:
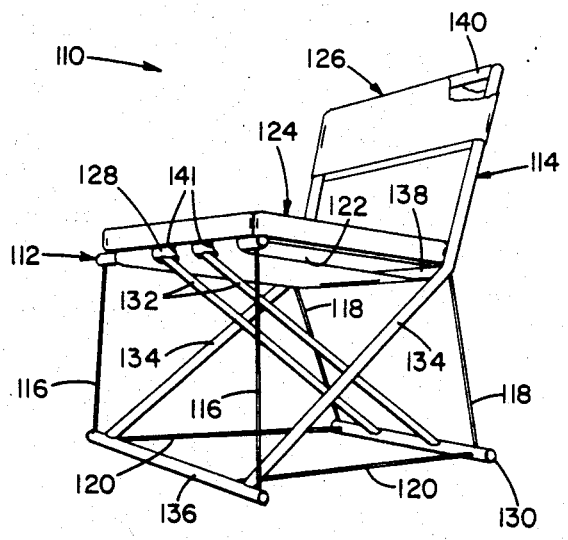
FIG. 5 is an isometric view, partly broken away, of a most preferred support structure embodying the invention and supporting a seat cushion and back.
Figure 6:
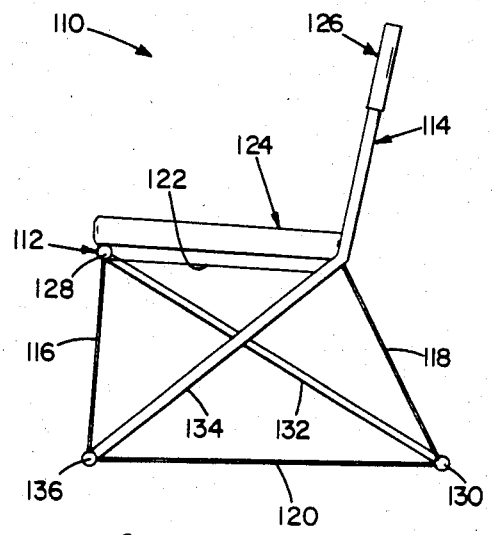
FIG. 6 is a side elevation of the FIG. 5 embodiment.

The most preferred embodiment is shown in FIGS. 5 and 6. Chair 110 includes oppositely inclined rigid members 112, 114, flexible tension cables 116, 118, 120, flexible tension member 122, seat cushion 124 and chair back 126. Rigid member 112 includes upper horizontal tubular member 128, lower horizontal tubular member 130, and spaced interconnecting inclined tubular members 132 welded to members 128, 130 to provide an integral rigid member. Rigid member 114 includes tubular dog-legged struts 134 connected by horizontal tubular members 136, 138, 140 welded between them. Struts 134 are inclined approximately 30° from the horizontal at their portions below tubular member 138; above tubular member 138 struts 134 are curved to provide upper portions making a steeper incline with the horizontal to provide support at the proper angle for chair back 126, made of fabric tautly fitted around and supported by tubular member 140 and the upper portions of struts 134. Flexible tension member 122 is an endless loop of fabric around horizontal tubular member 128 of rigid member 112 and horizontal tubular member 138 of rigid member 114; it has two holes 141 through which tubular members 132 pass, and supports seat cushion 122 on the upper portion of the loop. (Most preferably the endless loop is stitched near horizontal tubular members 128, 138, creating tunnels receiving these members.) Cables 116 extend between end portions of horizontal tubular member 128 of rigid member 112 and end portions of horizontal tubular member 136 of rigid member 114 near its connections to struts 134. Cables 118 are connected between the end portions of horizontal tubular member 130 of rigid member 112 and struts 134 at locations near horizontal tubular member 138. Cables 120 are connected between positions on tubular members 130, 136 near their ends. Cables 116, 118, 120 are connected to the tubular members by ball shank terminals on the cables that lock in key-shaped apertures in the tubular members, as shown in FIG. 2, in the FIGS. 5 and 6 embodiment; they could just as easily be connected by other means.

As can perhaps best be understood by reference to FIG. 6, cables 120 prevent rigid members 112, 114 from sliding away from each other on the floor; flexible tension member 122, in addition to supporting cushion 124, prevents rigid members 112, 114 from falling owing to gravity; rear cables 118 prevent rigid member 114 (and thus rigid member 112 owing to flexible tension member 122 connected to it) from pivoting forward, and front cables 116 prevent rigid member 112 (and thus rigid member 114 owing to flexible tension member 122 connected to it) from pivoting backward. Thus a rigid structure results. Cables 118 could be connected anywhere along struts 134, and they would still prevent forward pivoting; though as a practical matter, if they were close to cables 120, they would not be very effective. Cables 116 could similarly be connected anywhere along rigid member 112 to prevent backward pivoting of the structure.

Figure 7:
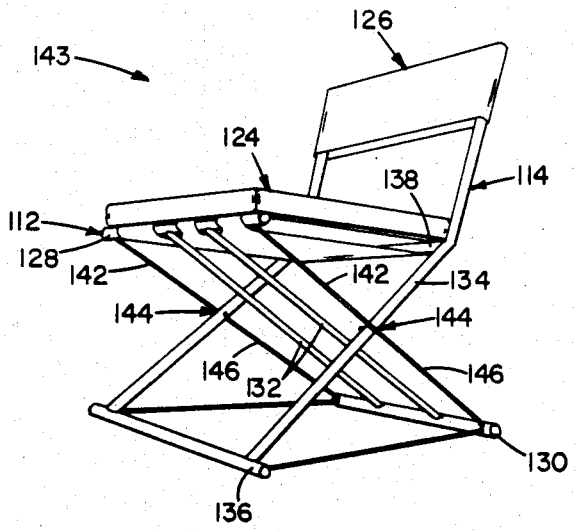
FIG. 7 is an isometric view of another support structure embodying the invention and supporting a seat cushion and back.

Referring to FIG. 7, another embodiment is shown. Chair 143 is identical in structure to chair 110 except that, in place of cables 116, it has cables 142 connected between horizontal tubular member 128 of rigid member 112 and connections 144 on struts 134 near where inclined tubular members 132 intersect an imaginary plane surface between struts 134, and, in place of a cables 118, it has cables 146 between horizontal tubular member 130 of rigid member 112 and connections 144. It can be seen that cables 146 prevent forward pivoting of rigid member 114 (and thus rigid member 112 also). As mentioned before with respect to cables 118, cables 146 could be connected any place along struts 134 and still prevent forward pivoting. Cable 142 prevents backward pivoting of rigid member 114, and can be located anywhere along struts 134 between horizontal tubular member 136 (this would be equivalent to cable 116) and about one-quarter of the distance from tubular member 138 to tubular member 136. (If it is any closer to flexible tension member 122, it would duplicate the action of member 122 and not effectively limit backward pivoting.)

Also, in the embodiments of FIGS. 5–7, the pair of cables can be replaced by single cables connected to the midpoints of the horizontal tubular members, and in the embodiments of FIGS. 1 to 4, the X-shaped members could be replaced by any rigid member that has two upper end portions and two lower end portions (e.g., something similar to rigid member 112).

Figure 8:
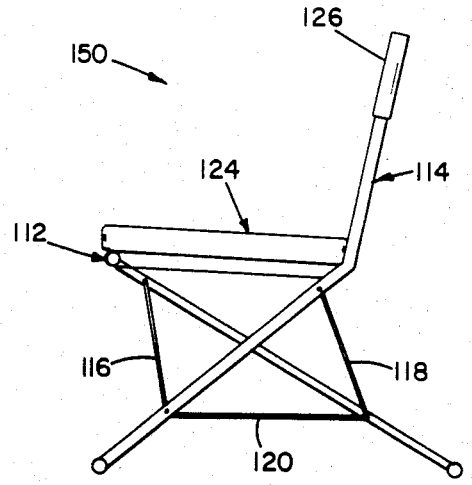
FIG. 8 is a side elevation of yet another support structure embodying the invention and supporting a seat cusion and back.

Also, in all embodiments the cables need not be connected as near to the ends of the struts and rigid members as they are in the disclosed examples, so long as they are connected to portions near the ends; an example is chair 150 shown in FIG. 8. Also the cables that prevent forward pivoting and the cables that prevent backward pivoting can be connected between the struts and the rigid member in ways different from those described above so long as they still function to prevent pivoting.

What is claimed is:

1. A substantially rigid support structure, comprising a pair of transversely spaced generally parallel rigid columnar struts, the axes of said struts being inclined with respect to the horizontal, an integral rigid member, oppositely inclined with respect to the horizontal, having two upper ends spaced from each other and two lower ends spaced from each other and positioned intermediate and spaced from said struts, a flexible tension member connecting each lower end of each strut with one lower end of the integral rigid member at the side adjacent said strut, a flexible tension member connecting each lower end of each strut with one upper end of the integral rigid member at the side adjacent said strut, a flexible tension member connecting each upper end of each strut with one lower end of the integral rigid member at the side adjacent said strut, a flexible tension member connecting each upper end of each strut with one upper end of the integral rigid member at the side adjacent said strut, and means for maintaining the upper end of said struts spaced apart from each other.

2. A support structure for a piece of furniture comprising a pair of transversely spaced rigid struts, the axes of said struts being inclined with respect to the horizontal and defining an imaginary planar surface passing through said struts, said struts having a first connection position and being curved above said first connection position so as to provide support for a chair back at a steeper angle from the horizontal than the angle made by said struts below said first connection position, means for maintaining said struts in substantially fixed relationship to each other, an integral rigid member, oppositely inclined with respect to the horizontal, having two upper end portions spaced from each other and two lower end portions spaced from each other and spaced from said struts, said integral rigid member intersecting said imaginary surface below said first connection position, a first flexible tension member connecting said integral rigid member at or near its said upper end portions to said struts at said first connection position on said struts, said first tension member being substantially horizontal and positioned to provide support for a seat cushion, a second flexible tension member connecting said integral rigid member at or near said two lower end portions to said struts at or near their bottoms, a third flexible tension member connecting said struts to said integral rigid member in position to prevent forward pivoting of said struts and said integral rigid member, and a fourth flexible tension member connecting said struts to said integral rigid member in position to prevent backward pivoting of said struts and said integral rigid member.

3. The support of claim 2 wherein said third tension member is connected to said integral rigid member at or near said lower end portions.

4. The support structure of claim 3 wherein said third tension member is connected to said struts at or near said first connection position.

5. The support structure of claim 2 wherein said fourth tension member is connected to said struts at or near their bottoms.

6. The support structure of claim 5 wherein said fourth tension member is connected to said integral rigid member at or near its upper end portions.

7. The support structure of claim 4 wherein said fourth tension member is connected to said struts at or near their bottoms and to said integral rigid member at or near its upper end portions.

8. The support structure of claim 2 wherein said struts are curved above said first connection position so as to provide support for a chair back at a steeper angle from the horizontal than the angle made by said struts below said first connection position.

9. The support structure of claim 2 further comprising additional second, third and fourth said tension members, resulting in pairs of tension members connected to corresponding positions on said integral rigid member and struts on opposite sides of said support structure.

10. A support structure for a piece of furniture comprising a pair of transversely spaced rigid struts, the axes of said struts being inclined with respect to the horizontal and defining an imaginary planar surface passing through said struts, means for maintaining said struts in substantially fixed relationship to each other, an integral rigid member, oppositely inclined with respect to the horizontal, having two upper end portions spaced from each other and two lower end portions spaced from each other and spaced from said struts, said integral rigid member intersecting said imaginary surface, a first flexible tension member connecting said integral rigid member at or near its said upper end portions to said struts at a first connection position on said struts above where said integral rigid member intersects said surface, a second flexible tension member connecting said integral rigid member at or near said two lower end portions to said struts at or near their bottoms, a third flexible tension member connecting said struts near where said surface intersects said rigid member to said integral rigid member at or near said lower end portions, and a fourth flexible tension member connecting said integral rigid member at or near its upper end portions to said struts at or near where said surface intersects said integral rigid member.

11. The support structure of claim 10 wherein said first tension member is substantially horizontal and is positioned to provide support for a seat cushion.

12. The support structure of claim 11 wherein said struts are curved above said first connection position so as to provide support for a chair back at a steeper angle from the horizontal than the angle made by said struts below said first connection position.

13. The support structure of claim 12 wherein said integral rigid member comprises two horizontal rigid members connected by an inclined rigid member, the end portions of one horizontal rigid member being said upper end portions, the end portions of the other said horizontal rigid member being said lower end portions.

* * * * *